US006520288B1

(12) United States Patent
Quam et al.

(10) Patent No.: US 6,520,288 B1
(45) Date of Patent: Feb. 18, 2003

(54) ACOUSTIC DOOR ASSEMBLY

(75) Inventors: Grant S. Quam, Owatonna, MN (US); Thomas A. Dettmann, New Prague, MN (US); Jay Iverson, Blooming Prairie, MN (US)

(73) Assignee: Wenger Corporation, Owatonna, MN (US)

( * ) Notice: Subject to any disclaimer, the term of this patent is extended or adjusted under 35 U.S.C. 154(b) by 0 days.

(21) Appl. No.: 09/545,539

(22) Filed: Apr. 7, 2000

(51) Int. Cl.[7] ..... E04B 1/343
(52) U.S. Cl. ..... 181/287; 49/399
(58) Field of Search ..... 52/144; 49/478.1, 49/397, 399; 181/284, 286, 288, 290, 291

(56) References Cited

U.S. PATENT DOCUMENTS

| | | | | | |
|---|---|---|---|---|---|
| 4,045,913 | A | | 9/1977 | Wright | |
| 4,658,878 | A | * | 4/1987 | Williams | 160/84 |
| 4,709,121 | A | | 11/1987 | Shores | |
| 4,924,969 | A | * | 5/1990 | L'Heureux | 181/290 |
| 4,998,598 | A | | 3/1991 | Mardian et al. | |
| 5,228,240 | A | * | 7/1993 | Barroero et al. | 49/386 |
| 5,309,680 | A | * | 5/1994 | Kiel | 49/478.1 |
| 5,327,684 | A | | 7/1994 | Herbst | |
| 5,371,987 | A | * | 12/1994 | Hirsch et al. | 52/207 |
| 5,416,285 | A | | 5/1995 | Niehaus | |
| 5,423,149 | A | | 6/1995 | Herbst | |
| 5,528,865 | A | * | 6/1996 | Johnson et al. | 49/501 |
| 5,742,980 | A | | 4/1998 | Nitta | |
| 5,768,836 | A | | 6/1998 | Bachmann | |
| 5,778,491 | A | | 7/1998 | Baer | |
| 6,170,210 | B1 | * | 1/2001 | Marts | 52/232 |

* cited by examiner

*Primary Examiner*—Robert E. Nappi
*Assistant Examiner*—Kim Lockett
(74) *Attorney, Agent, or Firm*—Patterson, Thuente, Skaar & Christensen, P.A.

(57) ABSTRACT

An acoustic door assembly generally comprises a door, a frame and a hinge. The door of the assembly is an insulated, acoustic door having a predetermined length. The frame of the assembly is positioned proximate the door and is joined thereto by the hinge. The hinge is a continuous, cam hinge having a length that is substantially equivalent to the predetermined length of the door and is secured along the length of the door.

20 Claims, 9 Drawing Sheets

ACOUSTIC DOOR ASSEMBLY

FIELD OF THE INVENTION

The present invention relates to doors and, more particularly, to doors incorporating enhanced sound isolation features.

BACKGROUND OF THE INVENTION

Acoustic doors are a significant element in the realm of performing arts centers, concert halls, broadcast studios, auditoriums and movie theaters as well as in industrial applications where noise or voice privacy may be required. To effect noise or voice privacy, i.e. isolate and absorb sound, it is important that a door be insulated, however, it is also important that the door seal tightly and, if possible, completely against its supporting frame.

However, many designs focus only on the structure of the door itself ignoring the involvement of the frame in obtaining effective sound absorption. For instance U.S. Pat. No. 4,998,598 describes an acoustic door wherein the door is comprised of multiple panels, each panel having three layers, to of which are high density materials such as hardboard; a door supporting frame is not discussed. Likewise, U.S. Pat. No. 5,416,285 describes an acoustical door wherein the door is comprised of multiple plies the plies being separated by spacer networks; again, a door supporting frame and the additional sound absorption features it may provide in combination with the door is not discussed.

U.S. Pat. No. 5,371,987 does discuss an acoustic combination of a door and frame. Specifically, the '987 patent describes an acoustical door and frame system wherein the door is secured to the frame via a plurality of cam hinges that are spaced along the length of the door. Upon closing the door against the frame, the cam hinges lower the door to be positioned against an elastomeric seal that extends along the sides and top of the frame. The elastomeric seals are held in adjustable retainers for positioning of the seals to create optimum interference with door and are compressed by the closing of the door.

The cam hinges used in the '987 patent help to move the door into a desired sealing position against the frame, however, because the hinges are spaced periodically along the door, complete support is not provided to the door allowing for the possibility of warpage in the position of the door and, therefore, the possibility of reduced sound isolation. Further, the use of an elastomeric seal, i.e. a soft and possibly porous seal, allows for the possibility of gaps between the door and frame and, therefore again, the possibility of reduced sound isolation.

In view of the above, there is a need for an acoustic door assembly that addresses the acoustic benefits that can be provided by the combination of a door and its supporting frame. Further, there is a need for an acoustic door and frame combination that is able to provide complete support to the door, thereby preventing warpage and the possibility of reduced sound isolation, and that is able to provide a seal between the door and frame that is not subject to gapping.

SUMMARY OF THE INVENTION

The needs described above are in large measure met by an acoustic door assembly of the present invention. The acoustic door assembly generally comprises a door, a frame and a hinge. The door of the assembly is an insulated, acoustic door having a predetermined length. The frame of the assembly is positioned proximate the door and is joined thereto by the hinge. The hinge is a continuous hinge having a length that is substantially equivalent to the predetermined length of the door and is secured along the length of the door.

In a preferred embodiment, the hinge is a cam-lift hinge. Further, the insulated, acoustic door is preferably comprised of a first portion and a second portion where at least of a section of the first and second portion are separated by an insulating layer. The first portion is then crimped about the insulating layer to join the first portion of the door to the second portion of the door. The door also preferably includes a TEFLON® fabric-coated sweep and may or may not include a viewing window. The frame preferably includes a dual-magnetic seal to which the hinge is positioned externally.

A method of constructing an acoustic door assembly generally includes the steps of erecting a frame and securing an insulated, acoustic door to the frame through use of a continuous hinge. The continuous hinge has a length that is substantially equivalent to the length of the door and is secured to the door along that length. The hinge is preferaly a can-lift hinge.

DESCRIPTION OF THE PREFERRED EMBODIMENTS

Figure 1:
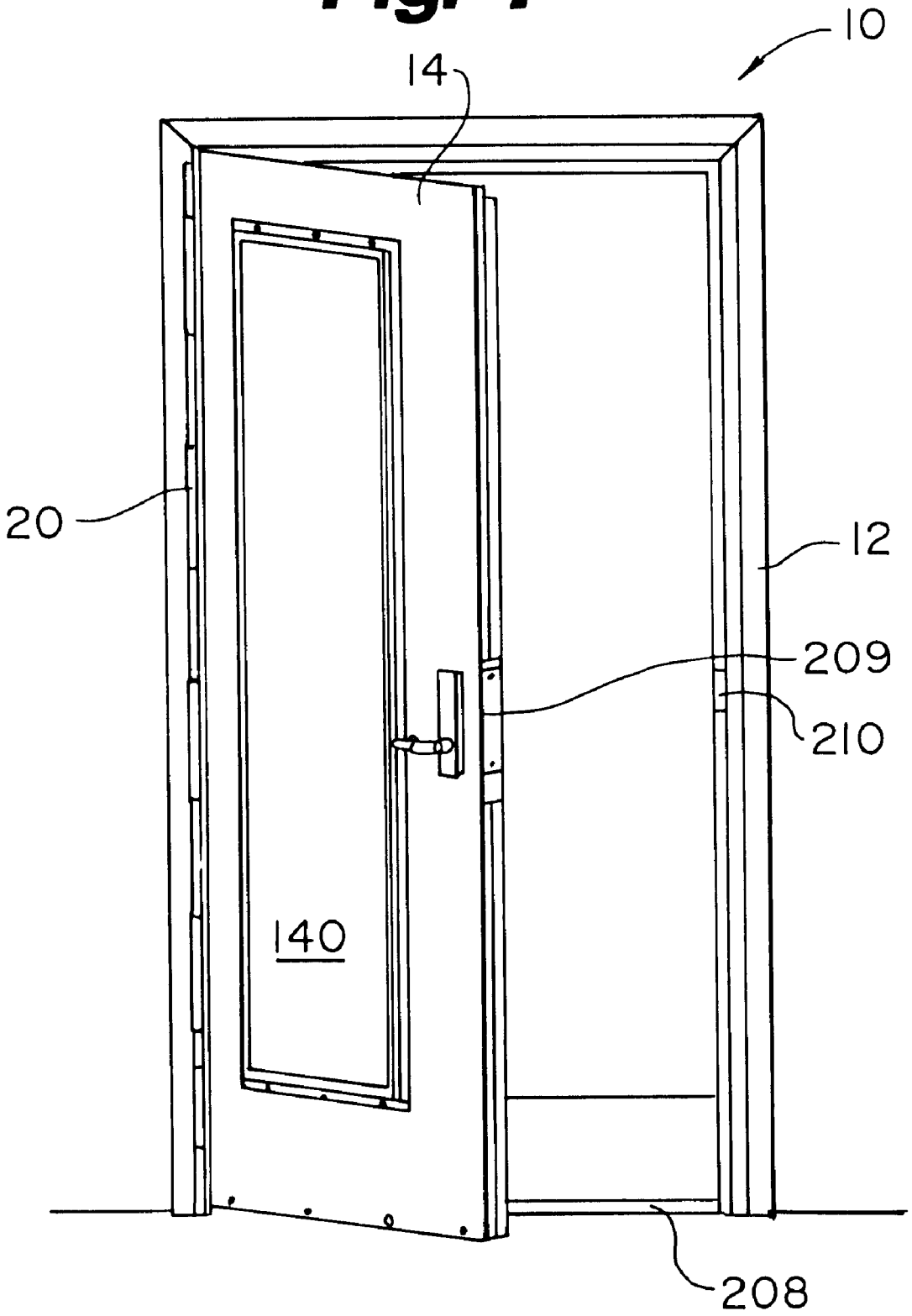
FIG. 1 is a perspective view of an acoustic door assembly of the present invention that includes a frame, door, and hinge; the door is in a semi-open position.

An acoustic door assembly 10 of the present invention, as depicted in FIGS. 1–21, and provides the user with improved sound isolation qualities. In general, acoustic door assembly 10 comprises a frame 12, an acoustic door 14 and a hinge 16.

Frame 12 is a split steel frame having a first weldment, i.e. first portion, 20 and a second weldment, i.e. second portion, 22. First weldment 20 of frame 12 is depicted in detail in FIGS. 3–5. As shown, first weldment 20 includes a pair of side walls 24 and a top wall 26 that joins the tops of side walls 24. Side walls 24 and top wall 26 incorporate a framing edge 28 that extends along the outer perimeter of each of walls 24 and 26. A cross brace 30 extends between the lower inner comers of side walls 24, and is included for shipping purposes only (removed upon installation of frame 12). One of side walls 24 incorporates a plurality of apertures 32 for insertion of rivet nuts 33 for the securing of hinge 16 to frame 12.

Figure 6:
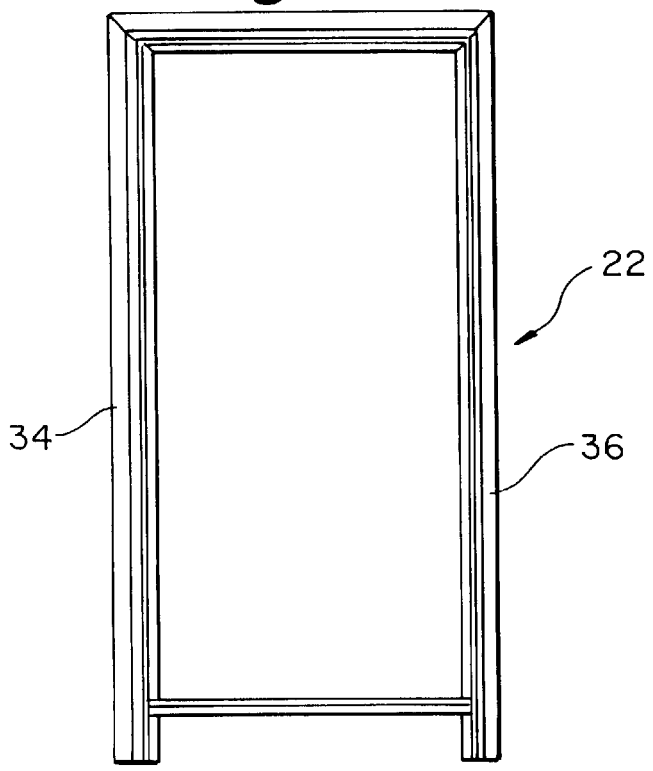
FIG. 6 is a front view of a second weldment of the frame of the acoustic door assembly.
Figure 7:
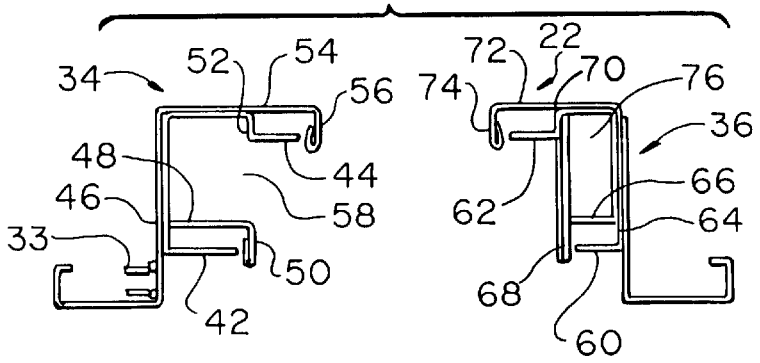
FIG. 7 is a cross-sectional view of the second weldment of FIG. 6.
Figure 8:
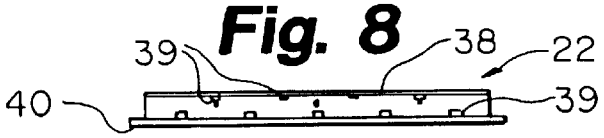
FIG. 8 is a top view of the second weldment of FIG. 6.

Second weldment 22 of frame 12 is depicted in detail in FIGS. 6–8. As shown, second weldment 22 includes a first side wall 34, a second side wall 36, and a top wall 38 joining first side wall 34 and second side wall 36. Each of walls 34, 36, and 38 incorporates a framing edge 40 that extends along its outer perimeter. Further, top wall 38 includes a plurality of slots 39 that extend along its exterior; slots 39 are welding sites used to secure second weldment to first weldment 20. Specifically, slots 39 are used to plug weld first weldment 20 to second weldment 22; additional welding to secure first weldment 20 and second weldment is provided 22 at the corners of the weldments 20, 22. Screws 41, shown by hidden lines in FIG. 2, secure side walls 34 and 36 to side walls 24 of first weldment 20.

First side wall 34 incorporates a first seal support rail 42 and a second seal support rail 44. First seal support rail 42 is bounded by a side wall 46, a rear wall 48, and a looped side wall 50. Second seal support rail 44 is bounded by a side wall 52, a rear wall 54, and a looped side wall 56. Via the various wall configurations, shown most clearly in FIG. 7, a substantially-square chamber 58 is formed intermediate first seal support rail 42 and second seal support rail 44.

Second side wall 36 also incorporates a first seal support rail 60 and a second seal support rail 62. First seal support rail 60 is bounded by a side wall 64, a rear wall 66 and a looped side wall 68. Second support rail 62 is bounded by a side wall 70, a rear wall 72, and a looped side wall 74. Via the various wall configurations shown most clearly in FIG. 7, a rectangularly-shaped chamber 76 is formed intermediate first seal support rail 60 and second seal support rail 62.

Figure 2:
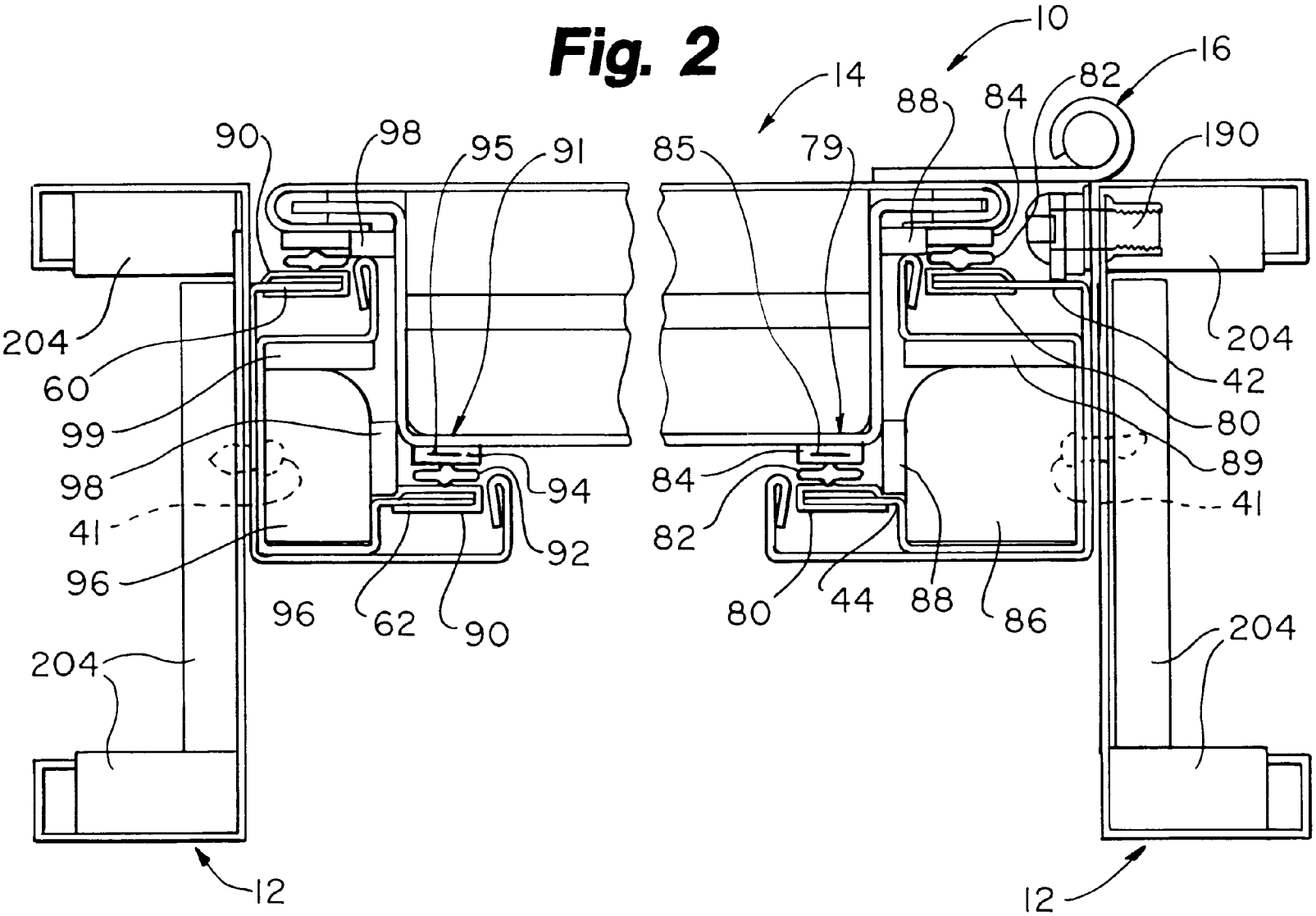
FIG. 2 is a cross-sectional view of the acoustic door assembly wherein the door is in a closed position.

Referring to FIG. 2, additional detail regarding the sealing structure of frame 12 is provided. As shown, first seal support rail 42 and second seal support rail 44 of first side wall 34 are each provided with a unitary, extruded vinyl seal 79 that includes a clip portion 80 that is slid over support rails 42 and 44. Each vinyl seal 79 further includes a central portion 82 that incorporates an air gap and an upper portion 84 that encases a magnet 85. A substantially square foam absorber 86 is placed within chamber 58 and additional neoprene foam absorbers 88 are provided as indicated on FIG. 2. A layer of intumescent material 89 is provided proximate foam absorber 86.

Likewise, first seal support rail 60 and second seal support rail 62 of second side wall 36 are each provided with a unitary, extruded vinyl seal 91 that includes clip portion 90 that is slid over support rails 60 and 62. Each vinyl seal 91 further includes a central portion 92 that incorporates an air gap and an upper portion 94 that encases a magnet 95. A rectangularly-shaped foam absorber 96 is placed within chamber 76 and additional foam absorbers 98 are provided as indicated on FIG. 2. A layer of intumescent material 99 is provided proximate foam absorber 96.

With respect to foam absorbers 86 and 96, they are comprised of open-cell urethane foam having two sides covered with non-woven cloth. Absorbers 86 and 96 are retained by interference-fit into chambers 58 and 76 and are captured by the geometry of the chamber. Pressure-sensitive adhesive may be applied to one or more of the surfaces of absorbers 86 and 96, if desired, to prevent unauthorized removal of the absorbers. With respect to foam absorbers 88 and 98, they are of a neoprene foam and are preferably adhered to frame 12. Intumescent material layers 89 and 99 are provided to foam and expand when heated to prevent smoke and ignitable gases from getting past seals 79 and 91, and are also adhered to frame 12.

Figure 9:
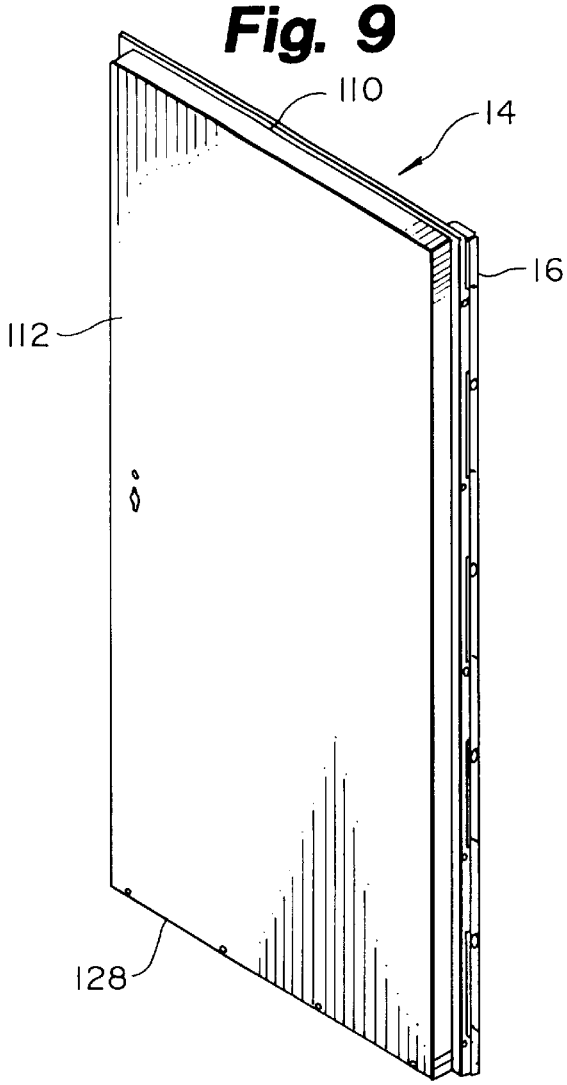
FIG. 9 is a perspective view of a solid door and hinge of the acoustic door assembly.
Figure 10:
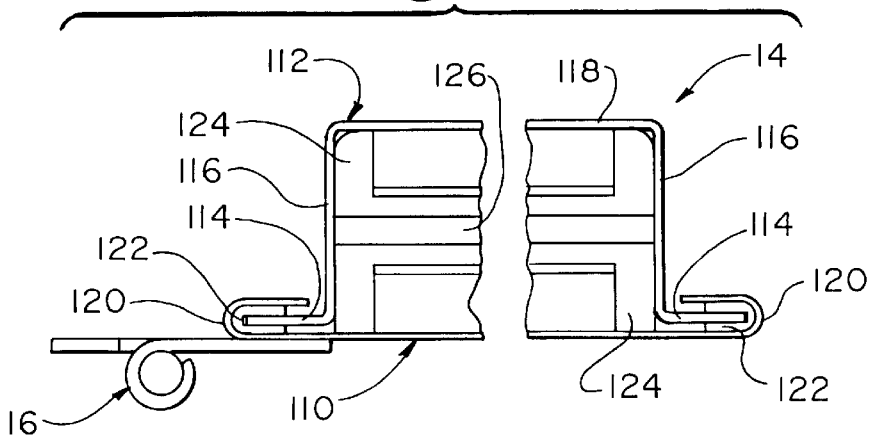
FIG. 10 is a cross-sectional view of the door and hinge of FIG. 9.

Referring to FIGS. 9 and 10, door 14 in a solid configuration is depicted. As shown, door includes a solid, outer leaf steel weldment 110 that is substantially planar in nature and a solid, inner leaf steel weldment 112 formed to include a pair of forward walls 114, a pair of side walls 116 and a rear wall 118 joining side walls 116. Outer leaf weldment 110 includes formed looping edges 120 that wrap about each of forward walls 114 crimping outer leaf weldment 110 to inner leaf weldment 112. A layer of neoprene rubber insulation 122 is provided between looping edges 120 and forward walls 114. Further, a recessed block of fiberglass insulation 124 is provided to the front and rear of inner leaf weldment 112. The recessed blocks of fiberglass insulation 124 are separated by an insulating layer of air 126. The lower portion of door 14 is provided with an adjustable height sweep 128 that is preferably coated in a TEFLON® fabric. Full length cam hinge 16, described in further detail below, is shown in the open position and is secured to door 14 by welding.

Figure 11:
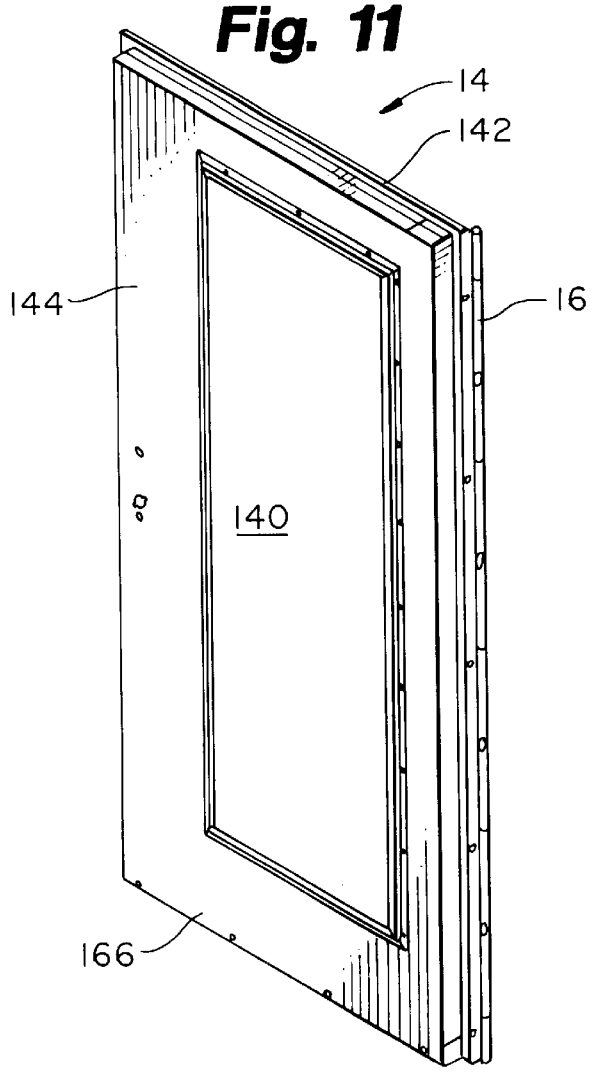
FIG. 11 is a perspective view of the door and hinge of the acoustic door assembly wherein the door incorporates a window.
Figure 12:
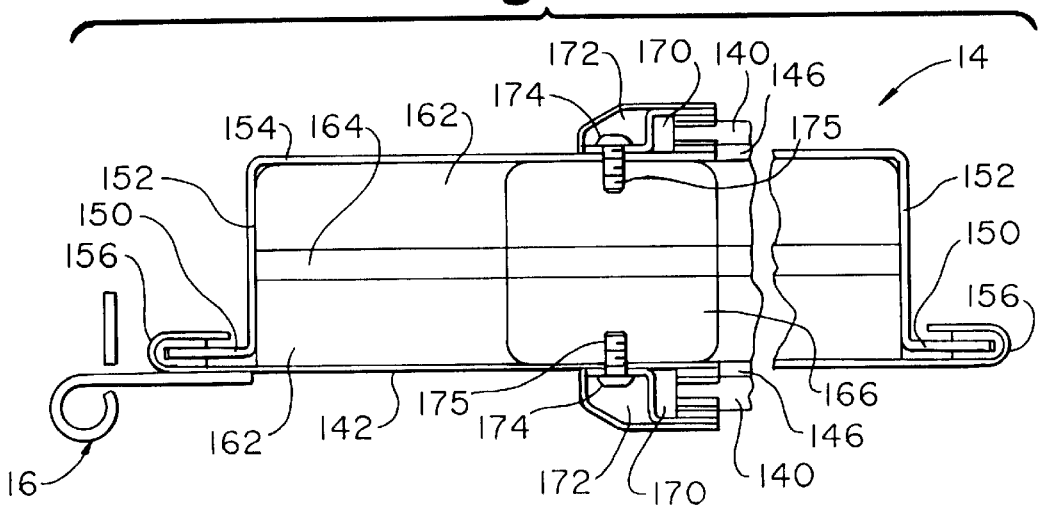
FIG. 12 is a cross-sectional view of the door and hinge of FIG. 11.
Figure 14:
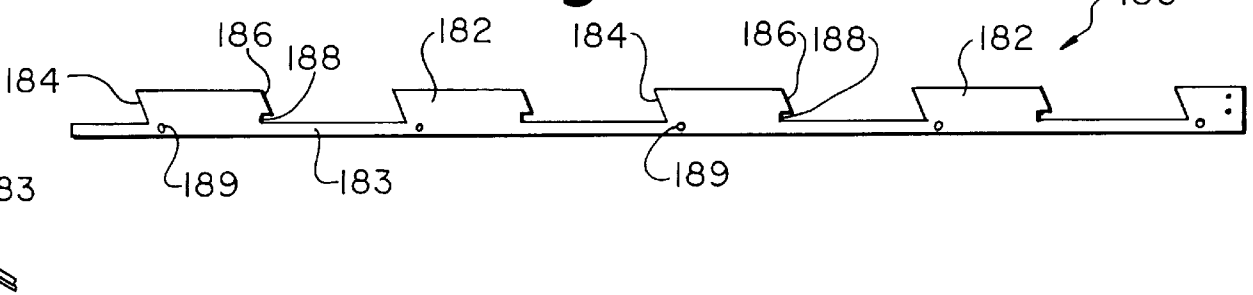
FIG. 14 is a side view of the first portion of the hinge of FIG. 13 prior to the winding of the hinge barrels.
Figure 13:
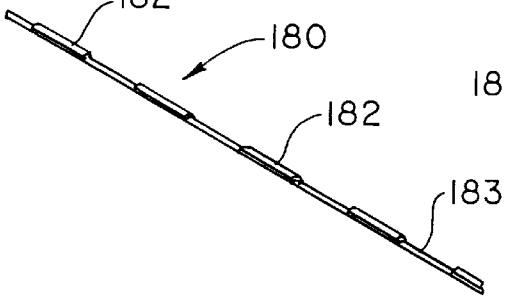
FIG. 13 is perspective view of a first portion of the hinge of the acoustic door assembly.
Figure 15:
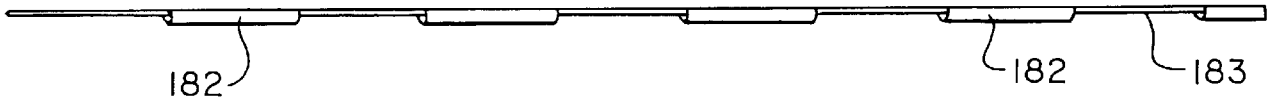
FIG. 15 is a side view of the first portion of the hinge of FIG. 13 after the winding of the hinge joints.
Figure 16:
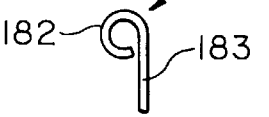
FIG. 16 is a cross-sectional view of the first portion of the hinge of FIG. 13.
Figure 18:
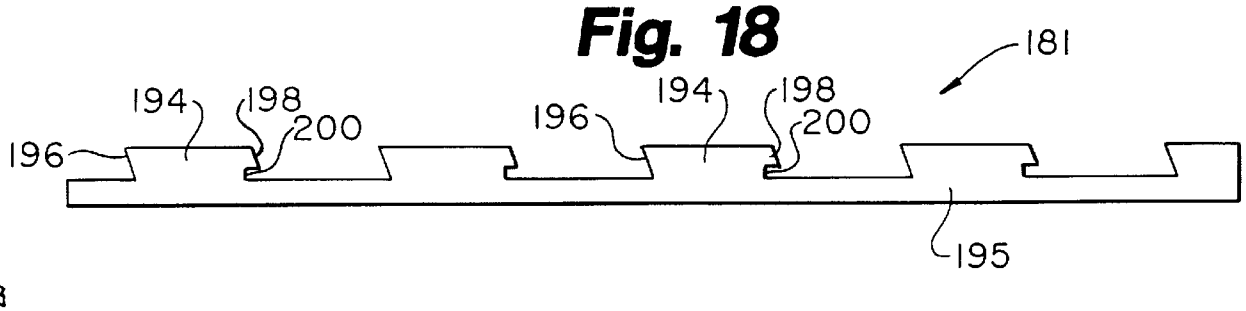
FIG. 18 is a side view of the mating portion of the hinge of FIG. 17 prior to the winding of the hinge joints.
Figure 17:
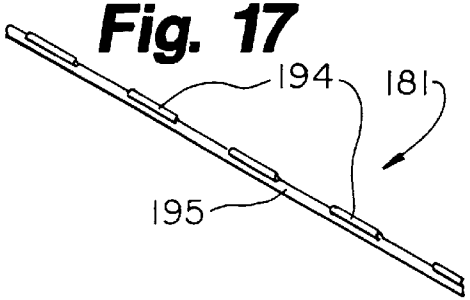
FIG. 17 is a perspective view of the mating portion of the hinge of the acoustic door assembly.
Figure 19:
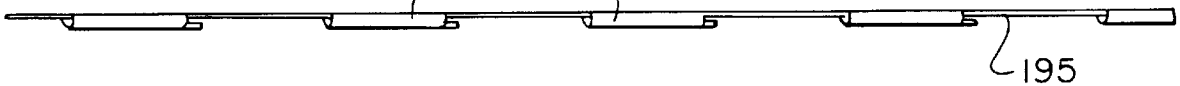
FIG. 19 is a side view of the female portion of the hinge of FIG. 17 after the winding of the hinge joints.
Figure 20:
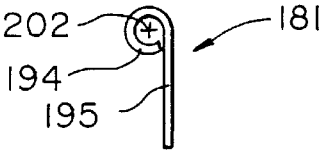
FIG. 20 is a cross-sectional view of the female portion of the hinge of FIG. 17.

Referring to FIGS. 11 and 12, door 14 incorporating a window 140 is depicted. Once again, door 14 includes an outer leaf weldment 142 and an inner leaf weldment 144 both incorporating an open window area 146. Outer leaf weldment 142 is substantially planar in nature while inner leaf weldment 144 is formed to include a pair of forward walls 150, a pair of side walls 152 and a rear wall 154 joining side walls 152. Outer leaf weldment 142 is formed to include looping edges 156 that wrap about each of forward walls 150 thereby crimping outer leaf weldment 142 to inner leaf weldment 144. A layer of neoprene rubber insulation 146 is provided between looping edges 156 and forward walls 150. On either side of open window area 146 is provided an open-cell foam block 160 to provide sound absorption at the sides of open window area 146. Blocks of fiberglass insulation 162 are provided, one to the front of inner leaf weldment 144 and one to the rear of inner leaf weldment 144. The blocks of fiberglass insulation 162 are separated by an insulating layer of air 164. The lower portion of door 14 is provided with an adjustable height sweep 166 that is preferably coated in a TEFLON® fabric. Full length cam hinge 16, described in further detail below, is shown in the closed position and is secured to door 14 by welding.

Figure 3:
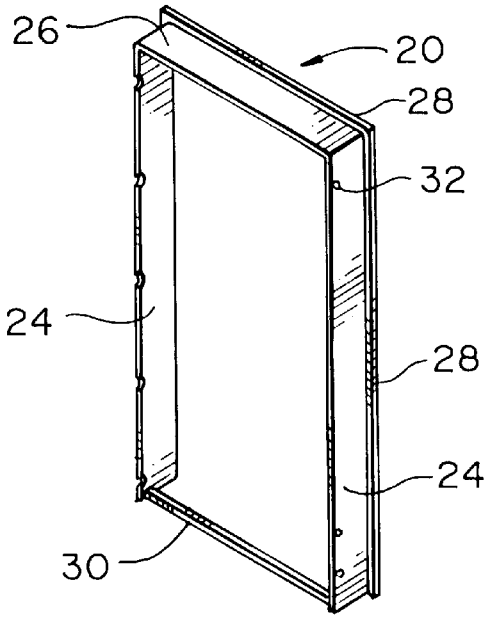
FIG. 3 is a perspective of a first weldment of the frame of the acoustic door assembly.
Figure 4:
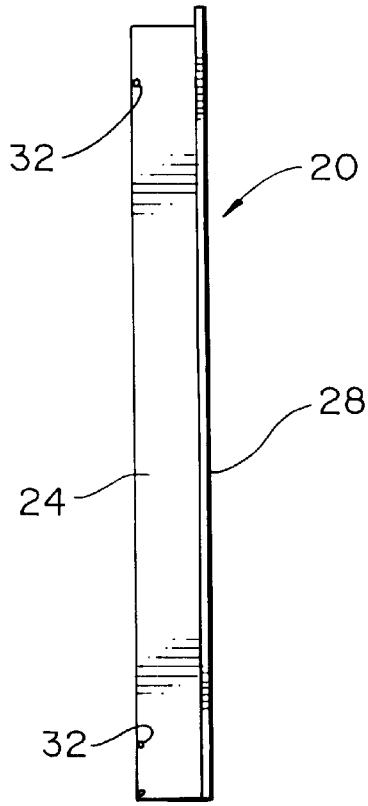
FIG. 4 is a side view of the first weldment of FIG. 3.
Figure 5:
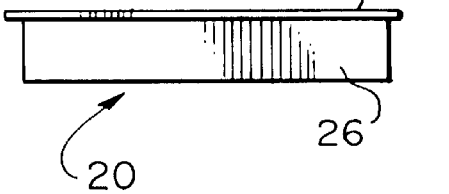
FIG. 5 is a top view of the first weldment of FIG. 3.
Figure 21:
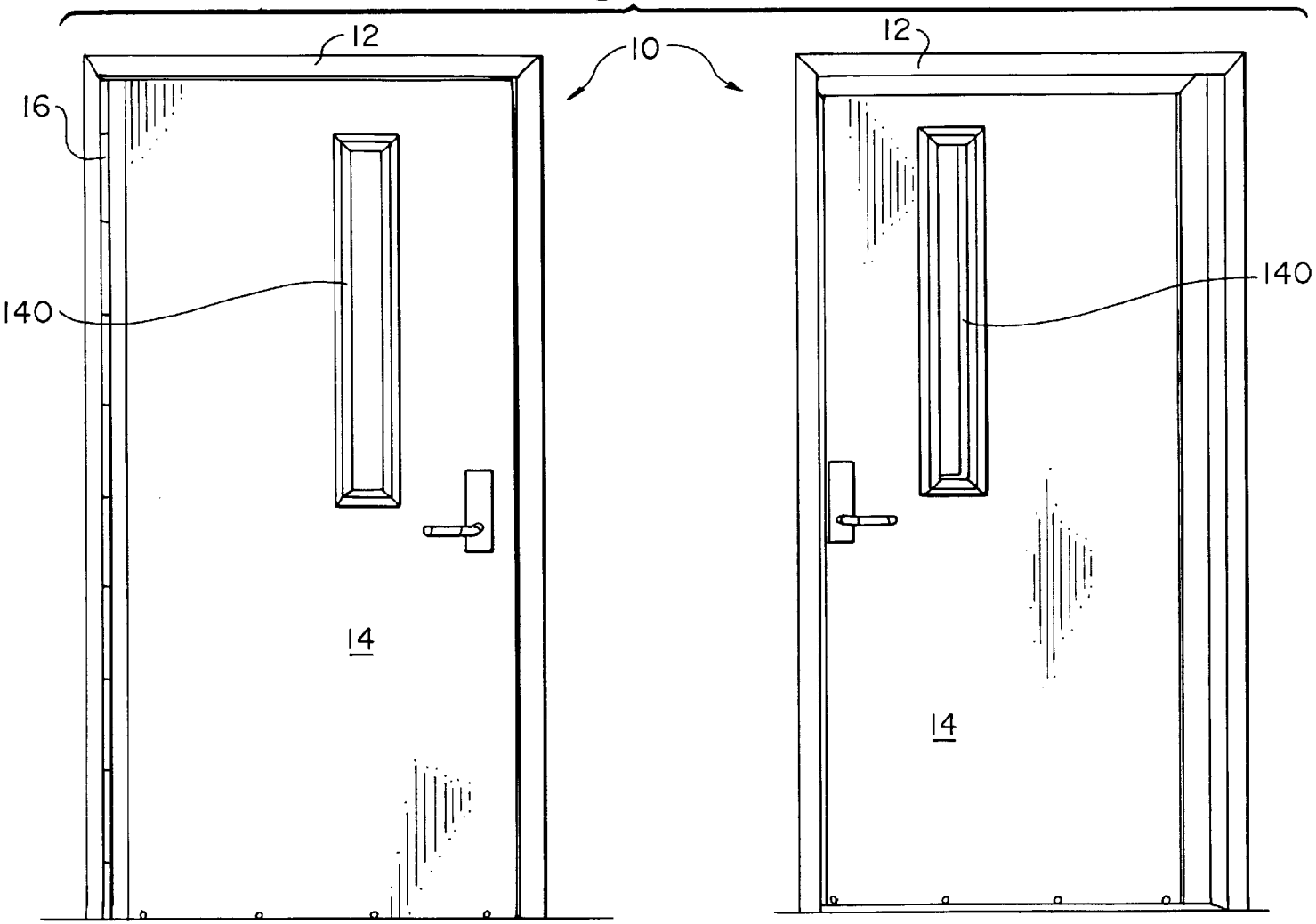
FIG. 21 provides a front and rear view of the acoustic door assembly of the present invention wherein the door incorporates a small window and is in the closed position.

With respect to window 140, it is comprised of two panes of glass, one surface mounted to outer leaf weldment 142 and one to inner leaf weldment 144. The edge of each pane of glass is surrounded by a u-channel rubber gasket 170. A retaining strip 172 is placed over gasket 170 about the perimeter of window 140 and secured to door 14 with a plurality of button-head screws 174. Each of screws 174 passes through outer leaf weldment 142 or inner leaf weldment 144 and threads into a pre-threaded weld nut 175 welded to the inner surface of the inner and outer leaf weldments 144, 142, as shown in FIG. 12. Window 140 may be of any suitable size and shape without departing from the spirit or scope of the invention, e.g. 20 inches by 64 inches as shown in FIGS. 1 and 11, 3 inches by 33 inches as shown in FIG. 21, etc.

Full-length cam hinge 16 is comprised of a first portion 180, see FIGS. 13–16, and a mating portion 181, see FIGS. 17–20, which extends the full length of door 14. First portion 180 of cam hinge 16 is die-stamped to provide a plurality of barrels 182 and a barrel support 183. Each of barrels 182 is provided with a first ramped end 184 and a second ramped end 186, wherein second ramped end 186 additionally incorporates a notch 188. Barrel support 183 is provided with a plurality of apertures 189 for the securing of cam hinge 16 to frame 12 with screws 190, see FIG. 2. After the die-stamping of first portion 180, the plurality of barrels 182 are rounded, see FIG. 15, to produce the cross-section of FIG. 16.

Mating portion 181 of full-length cam hinge 16, FIGS. 17–20, is also die-stamped to provide a plurality of barrels 194 and a barrel support 195. Each of barrels 194 is provided with a first-ramped end 196 and a second ramped end 198, wherein second ramped end 198 incorporates a notch 200. After the die-stamping of mating portion 181, the plurality of barrels 194 are rounded, see FIG. 19, to produce the cross-section of FIG. 20. Each of barrels 194 is positioned along barrel support 195 to mate with barrels 182 of first portion 180 such that first ramped end 184 mates with first ramped end 196 and second ramped end 186 mates with second ramped end 198. A pin 202 secures first portion 180 to mating portion 182. Rotation of mating portion 181, which is fixed to door 14 by welding, relative to first portion 180, which is fixed to frame 12 with screws, provides a lifting and a lowering, i.e. cam, action.

To assemble acoustic door assembly 10, reference is made once again to FIG. 2 whereby it can be seen that first weldment 20 and second weldment 22 are joined to create frame 12 utilizing screws 41, which are depicted with hidden lines. Additional insulating blocks 204, of closed-cell urethane foam, are provided at the outer perimeters of frame 12 and are adhered to the inside of the frame. The user's door 14 of choice, e.g. with or without window 140, is then secured to frame 12 by aligning apertures 189 of full-length cam hinge 16 with apertures 32 frame 12 and securing with screws 190 threaded into rivet nuts 33. Referring to FIG. 1 (acoustic door assembly 10 in an open position) and FIG. 21 (acoustic door assembly 10 in a closed position, front and back), door 14 and frame 12 are preferably placed over a flat plate threshold 208 and are provided with a mortise style latch 209 and strike plate 210.

In use, acoustic door assembly 10 provides the user with improved sound isolation qualities. Specifically, upon closing door 14 against frame 12, see again FIG. 2, an uninterrupted dual magnetic seal 79, 91 is provided on each side of door 14 wherein each side of rear wall 118, 154 of inner leaf weldment 112, 144 is in contact with one of magnetic seals 79, 91 and each of looping edges 120, 156 of outer leaf weldment 110, 142 is in contact with one of magnetic seals 79, 91. A magnetic seal is especially effective in enhancing sound isolation of door 14 as a complete seal, e.g. essentially no air gaps, exist between magnetic seals 79, 91 and metal door 14. Air spring 82 helps to ensure a tight seal by compressing upon door 14 closing against frame 12. Additional sound isolation is provided by the numerous foam portions, i.e. 86, 88, 96, 98, and 204, within frame 12 itself as well as the foam, air and fiberglass layers, i.e. 124, 160, and 126 or 162, 160 and 164, within door 14.

Further sound isolation enhancement is provided by hinge 16. The lifting, or cam, nature of hinge 16 ensures that door 14 is lowered into the appropriate position against frame 12 to ensure a substantially complete seal between frame 12 and door 14 as well as substantially complete sound isolation. The full-length nature of hinge 16 ensures complete support between door 14 and frame 12 thereby substantially eliminating any warpage between door 14 and frame 12, and substantially eliminating the possibility of reduced sound isolation.

Because hinge 16 is outside of the magnetic sealing area, the seal created between magnetic seals 79 and door 14 is not disturbed by hinge attachment brackets and hardware. The adjustable height sweep that is preferably coated in a TEFLON® fabric, 128 or 166, also helps to maintain sound isolation. Upon opening of door 14, cam lift hinge 16 lifts door 14 so that the sweep seal 128, 166 lifts off the floor after a small amount of door swing. Thus, the sweep seal 128, 166 does not have to slide on the floor throughout the full travel of door 14. As such, both sweep seal 128, 166 and the user's floor suffer minimal wear. In the instance of door 14 incorporating window 140, sound absorptive features are also provided. Specifically, open-cell foam 160, u-channel rubber gasket, and retaining strip 172 help to improve sound absorption.

Utilizing the above-described embodiment, acoustic door assembly 10 of the present invention, with or without a window, is able to provide the user with a desirable STC rating of 49. STC stands for "sound transmission class" and is a single number rating derived from measured values of sound transmission loss (TL) in accordance with the American Society for Testing and Materials (ASTM) E90 standards. TL through a door is a measure of its effectiveness in preventing the sound power incident on one side from being transmitted through it and radiated on the other side, taking into account the area of the door and the absorption in the receiving room. The STC provides a single number estimate of a door's performance for certain common sound reduction applications. A desirable fire rating of 45 minutes (door with 20 inch by 64 inch window) to one hour (solid door or door with 3 inch by 33 inch window) per UL 10B is also provided by the present invention.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. An acoustic door assembly comprising:

an insulated, acoustic door having a predetermined length;

a frame proximate said insulated, acoustic door; and a hinge, wherein said hinge is continuous and substantially equivalent in length to said predetermined length of said insulated, acoustic door, and wherein said hinge is secured to said insulated, acoustic door along substantially the full length of said predetermined length and to said frame, wherein said insulated, acoustic door comprises a first portion and a second portion, and wherein a layer of insulation separates a least a section of said first portion from said second portion, and wherein said first portion is crimped over said layer of insulation to join said first portion and said second portion.

2. The assembly of claim 1, wherein said hinge comprises a cam-lift hinge.

3. The assembly of claim 1, wherein said frame includes a dual-magnetic seal.

4. The assembly of claim 3, wherein said hinge is external to said dual-magnetic seal.

5. The assembly of claim 1, wherein said insulated, acoustic door includes a fluoropolymer fabric-coated sweep seal.

6. The assembly of claim 5, wherein said hinge comprises a cam-lift hinge and wherein said cam-lift hinge raised said sweep seal off a floor upon opening of said insulated, acoustic door.

7. The assembly of claim 1, wherein said insulated, acoustic door includes a window.

8. An acoustic door assembly, comprising:

insulating means for providing sound absorption;

sealing means for sealing against said insulating means; and pivoting means for continuously joining said insulating means and said sealing means along a substantially entire length of said insulating means and allowing said insulating means to pivot relative said sealing means, wherein said insulating means comprises a first surface means for presenting a rigid surface, a second surface means for presenting a rigid surface, and a separation means for separating at a least a section of said first surface means from said second surface means, and wherein said first surface means is crimped about said separation means to join said first surface means and said second surface means.

9. The assembly of claim 8, wherein said pivoting means is for lowering said insulating means to meet said sealing means.

10. The assembly of claim 8, wherein said sealing means includes a dual-magnetic sealing means for establishing a magnetic seal between said sealing means and said insulating means.

11. The assembly of claim 10, wherein said pivoting means is positioned external to said dual-magnetic sealing means.

12. The assembly of claim 8, wherein said insulating means includes a sweep means for sealing said insulating means to a threshold and wherein said sweep means includes a fluoropolymer fabric coating.

13. The assembly of claim 12, wherein said pivoting means for raising sweep means off of a floor upon an opening of said insulating means.

14. A method of constructing an acoustic door assembly:

erecting a frame; and assembling an insulated, acoustic door, wherein said step of assembling comprises separating a section of a first portion of said insulated, acoustic door from a second portion of said insulated, acoustic door with a layer of insulation and crimping said first portion about said insulation to join said first portion and said second portion of said insulated, acoustic door; and securing said insulated, acoustic door having a predetermined length to said frame through the use of a continuous hinge having a length substantially equivalent to said predetermined length, wherein said hinge is secured to said insulated, acoustic door along substantially the full length of said predetermined length.

15. The method of claim 14, wherein said step of erecting said frame comprises joining a first portion of said frame to a second portion of said frame.

16. The method of claim 14, wherein said hinge is a cam-lift hinge.

17. The method of claim 14, further comprising the step of securing a dual-magnetic seal to said frame.

18. The method of claim 17, wherein said hinge is external to said dual-magnetic seal.

19. The method of claim 14, further comprising the step of providing said insulated, acoustic door with a fluoropolymer-fabric coated sweep seal.

20. The method of claim 14, further comprising the step of providing said insulated, acoustic door with a viewing window.

* * * * *

UNITED STATES PATENT AND TRADEMARK OFFICE

CERTIFICATE OF CORRECTION

PATENT NO. : 6,520,288 B1 
DATED : February 18, 2003
INVENTOR(S) : Quam et al.

It is certified that error appears in the above-identified patent and that said Letters Patent is hereby corrected as shown below:

Column 1,
Line 24, delete "to" and insert -- two --.
Line 41, after "with" insert -- the --.

Column 2,
Line 8, after "least" delete "of".

Column 3,
Line 20, delete "comers" and insert -- corners --.
Line 35, delete "weldment is provided 22" and insert -- weldment 22 is provided --.

Column 4,
Line 25, after "door" insert -- 14 --.

Column 6,
Line 1, delete "exist" and insert -- exists --.
Line 48, "10B" should not be bolded.

Column 7,
Line 3, delete the first occurrence of "a" and insert -- at --.
Line 34, after "at" delete "a".

Signed and Sealed this

Twenty-fourth Day of June, 2003

JAMES E. ROGAN
*Director of the United States Patent and Trademark Office*